United States Patent [19]

Naka

[11] 4,253,859

[45] Mar. 3, 1981

[54] GAS REFRIGERATOR

[75] Inventor: Keisuke Naka, Nishio, Japan

[73] Assignee: Aisin Seiki Kabushiki Kaisha, Kariya, Japan

[21] Appl. No.: 99,012

[22] Filed: Nov. 30, 1979

[30] Foreign Application Priority Data

Dec. 27, 1978 [JP] Japan ..... 53/162702

[51] Int. Cl.[3] ..... F25B 9/00

[52] U.S. Cl. ..... 62/6

[58] Field of Search ..... 62/6

[56] References Cited

U.S. PATENT DOCUMENTS

| | | | |
|---|---|---|---|
| 3,367,121 | 2/1968 | Webb | 62/6 |
| 3,523,427 | 8/1970 | Simpson | 62/6 |
| 3,793,846 | 2/1974 | Dehive | 62/6 |

*Primary Examiner*—Ronald C. Capossela

*Attorney, Agent, or Firm*—Finnegan, Henderson, Farabow, Garrett & Dunner

[57] ABSTRACT

A gas refrigerator including a driving section comprises a first piston-cylinder mechanism for compressing a gaseous refrigerating medium and a second piston-cylinder mechanism for compressing a gaseous driving medium, the first and second piston-cylinder mechanisms being driven with a phase difference of approximately 90°, and a refrigerating section comprising a cylinder and a floating piston disposed in the cylinder to define an expansion chamber at one end and a driving chamber at the other end. The first and second piston-cylinder mechanisms respectively communicate through conduits which may be constructed of flexible material, with the expansion and driving chambers. A gas cooling device is provided in the first piston-cylinder mechanism.

8 Claims, 3 Drawing Figures

GAS REFRIGERATOR

BACKGROUND OF THE INVENTION

The present invention relates to gas refrigerators and more particularly to a Kirk-cycle gas refrigerator in which rod members are utilized to effect volumetric changes of a refrigerating medium so that an extremely low temperature can be produced.

Conventionally, in such Kirk-cycle gas refrigerators, the rod member is mechanically connected to a piston provided in a volume-variable space. Thus, the cryogenic section is mechanically connected to the driving section so that mechanical vibrations produced in the driving section are transmitted to the cryogenic section.

This, however, has the tendency to sometimes cause problems, particularly in the case where the apparatus is used as a cryopump. Further, the apparatus becomes very large in relation to the cryo-section so that handling of the apparatus becomes difficult as well as inconvenient.

SUMMARY OF THE INVENTION

It is therefore an object of the present invention to provide a Kirk-cycle refrigerator in which transmittal of vibrations of the driving section can be prevented.

Another object of the present invention is to provide a Kirk-cycle refrigerator in which the cryogenic section can be positioned apart from the driving section.

According to the present invention, the above and other objects can be accomplished by a gas refrigerator comprising a driving section which includes first compressing means for cyclically compressing a refrigerating gaseous medium with a phase different from that of the second compressing means, cylinder means having floating piston means defining, at one side thereof, expansion chamber means and at the other side thereof, driving chamber means, first conduit means connecting the first compressing means with the expansion chamber means, second conduit means connecting the second compressing means with the driving chamber means so that the floating piston means is driven by the driving gaseous medium and means for cooling the refrigerating gaseous medium compressed at the first compressing means.

Means may be provided in the first conduit means for accumulating a low temperature.

The first and second compressing means may be composed of piston-cylinder mechanisms and the driving section may include a crank mechanism which drives the pistons in the first and second compressing means in different phases.

According to the features of the present invention, the cryogenic section, as defined by the cylinder means, is connected to the driving section by means of first and second conduit means so that the cryogenic section can be located apart from the driving section. Further, it is possible to prevent transmittal of vibrations from the driving section to the cryo-section.

The above and other objects and features of the present invention will become apparent from the following description of a preferred embodiment with reference to the accompanying drawing, in which;

Figure 1:
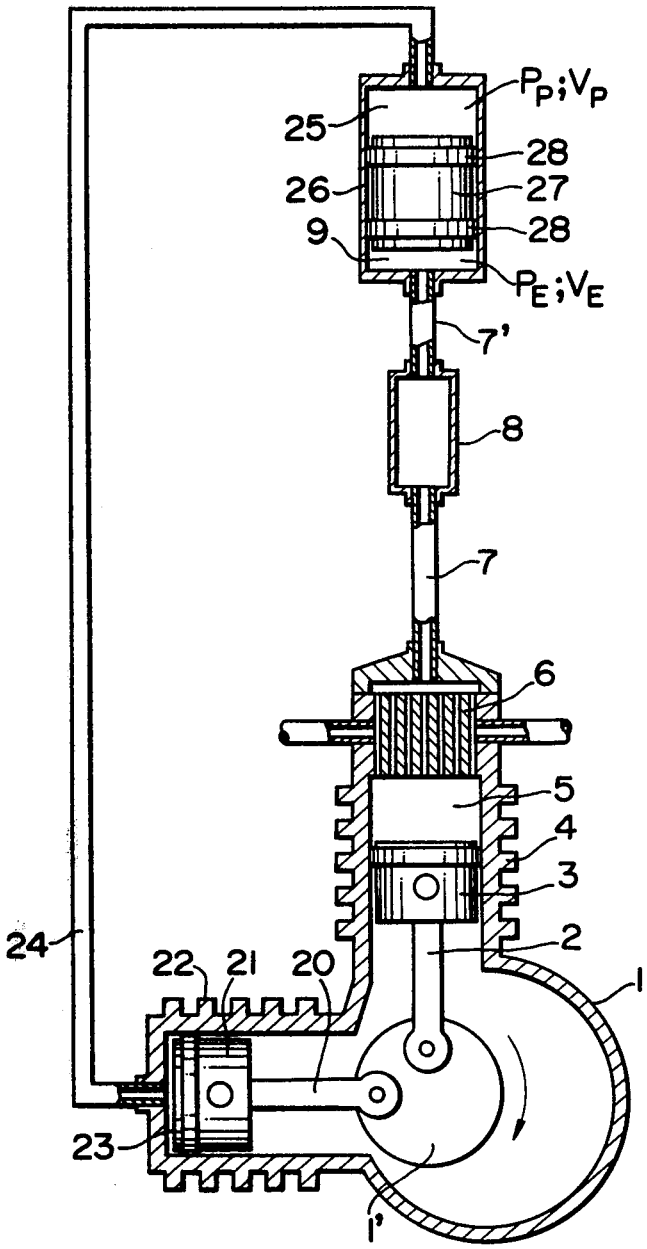
FIG. 1 is a sectional view of a gas refrigerator in accordance with one embodiment of the present invention.

Referring to the drawings, particularly to FIG. 1, the gas refrigerator shown therein includes a crank mechanism 1' housed in a crankcase 1. A first cylinder 4 is formed with the crankcase 1 and a first piston 3 is disposed in the first cylinder 4 to define a compression chamber 5 for containing a refrigerating gaseous medium such as helium gas. The piston 3 is connected to the crank mechanism 1' through a connecting rod 2.

In the cylinder 4, there is provided a gas cooler 6 so that the refrigerating gaseous medium compressed in the compression chamber 5 flows through a conduit 7 to a cryo-accumulator 8 which is in turn connected through a conduit 7' to a cylinder 26. In cylinder 26, which is connected at one end to the conduit 7', there is disposed a floating piston 27 provided with sealing rings 28. Thus, an expansion chamber 9 is defined at one end of the piston 28 and a driving chamber 25 at the other end. The conduit 7' is connected to and communicates with the expansion chamber 9.

A cylinder 22 is formed with the crankcase 1 and a piston 21 is disposed in the cylinder 22 to define a chamber 23. The piston 21 is connected to the crank mechanism 1' by means of a connecting rod 20. In this embodiment, the piston 21 is moved with a phase difference of approximately 90°. The crank mechanism 1' is rotated by means of a suitable power source in the direction as shown by an arrow in FIG. 1. The chamber 23 in the cylinder 22 communicates, through a conduit 24, with the driving chamber 25 of the cylinder 26.

Figure 2:
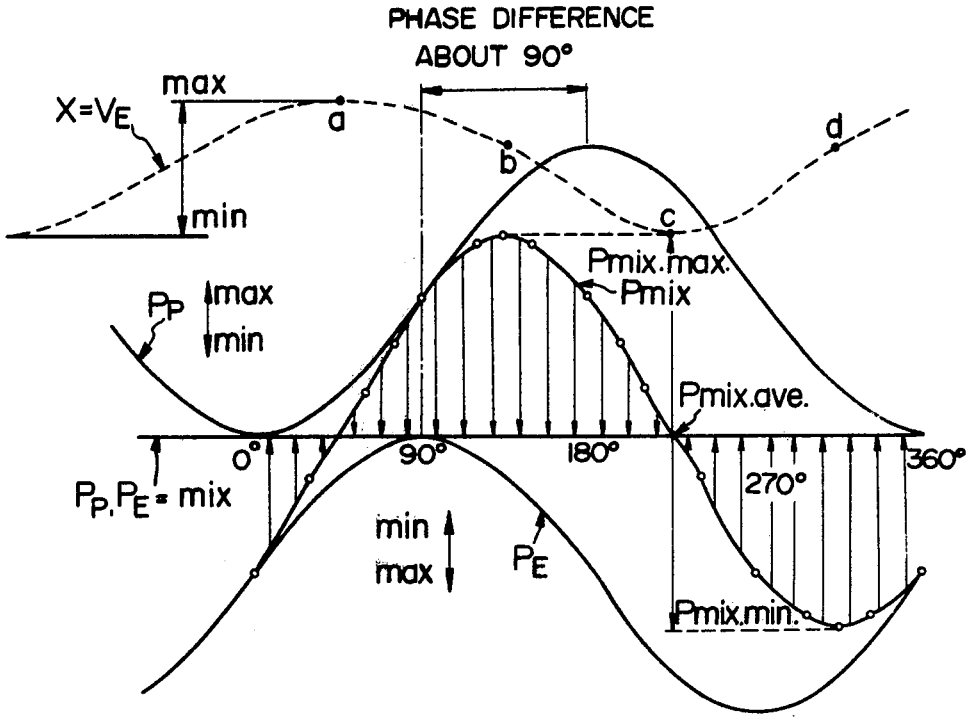
FIG. 2 is a diagram showing operating cycles in accordance with the present invention.

In operation, when the crank mechanism 1' is rotated, the piston 3 is reciprocatingly moved through the connecting rod 2 so that the refrigerating gaseous medium in the compression chamber 5 is cyclically compressed. The pressure of the gaseous medium in the compression chamber 5 is transmitted through the conduit 7, the cryo-accumulator 8 and the conduit 7' to the expansion chamber 9. In FIG. 2, the pressure change is shown by the curve $P_E$.

Figure 3:
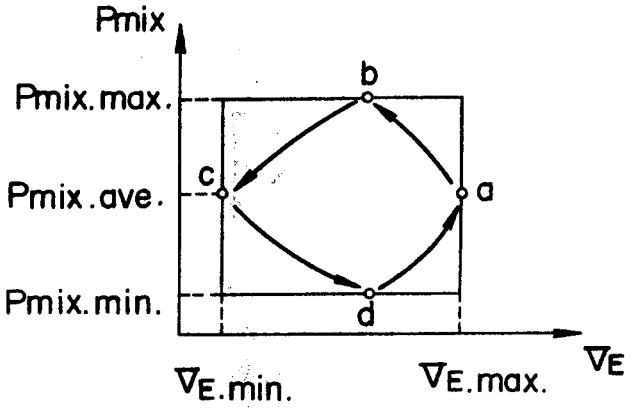
FIG. 3 is a diagram showing the refrigerating cycle of the present invention.

At the same time, the piston 21 is also moved reciprocatingly to compress the driving gaseous medium in the chamber 23 and the pressure in the chamber 23 is transmitted through the conduit 24 to the driving chamber 25. The pressure change is shown by the curve $P_p$ in FIG. 2. Thus, the floating piston 27 is subjected at opposite ends thereof to the pressures $P_E$ and $P_p$. The floating piston 27 is therefore subjected to a composite pressure which changes as shown by Pmix in FIG. 2. The composite pressure moves the piston 27, as shown by a dotted line X in FIG. 2, so as to effect a corresponding change in the volume $\overline{V}_E$ of the expansion chamber 9. At points a, b c and d on the curve X, the corresponding volume $\overline{V}_E$ of the chamber 9 is shown in FIG. 3. It will be noted that the relationship between the composite pressure on the piston 27 and the volume $\overline{V}_E$ of the expansion chamber 9 constitutes a refrigerating cycle.

According to the present invention, the cryo-section is separated from the driving section and connected therewith through conduits which may be of flexible nature.

It is therefore possible to prevent the vibrations of the driving section from being transmitted to the cryo-section. Thus, the refrigerator in accordance with the present invention is very advantageous in certain uses, such a cryo-pump.

It should be further noted that the floating piston moves in such a manner that the pressures at the opposite ends of the piston are substantially balanced. Therefore, the sealing rings on the floating piston are not subjected to a large pressure difference so that the life of the seals is remarkably prolonged.

The invention has thus been shown and described with reference to a specific embodiment, but, however, it should be noted that the invention is in no way limited to the details of the illustrated structures and changes and modifications may be made without departing from the scope of the appended claims.

What we claim is:

1. A gas refrigerator comprising a driving section which includes first compressing means for cyclically compressing a refrigerating gaseous medium and second compressing means for cyclically compressing a driving gaseous medium with a phase different from that of the first compressing means, cylinder means having floating piston means defined at one end of expansion chamber means and at the other end, driving chamber means, first conduit means communicating said first compressing means with said expansion chamber means, second conduit means communicating said second compressing means with said driving chamber means so that said floating piston means is driven by said driving gaseous medium and means for cooling said refrigerating gaseous medium compressed in said first compressing means.

2. A gas refrigerator in accordance with claim 1, wherein said first conduit means is provided with means for accumulating a low temperature therein.

3. A gas refrigerator in accordance with claim 1, wherein said cooling means is located in said first compressing means.

4. A gas refrigerator in accordance with claim 1, wherein said compressing means is driven by crank means at a predetermined phase difference for compressing a gaseous medium therein.

5. A gas refrigerator in accordance with claim 4, wherein said predetermined phase difference is substantially 90° C.

6. A gas refrigerator in accordance with claim 4, wherein said first compressing means comprises a first cylinder for reciprocating movement to define a first compression chamber which communicates through said first conduit means with said expansion chamber means, and said second compressing means comprises a second cylinder and a second piston disposed in said second cylinder for reciprocating movement to define a second compression chamber which communicates through said second conduit means with said driving chamber means, said crank means being connected respectively through first and second connecting rods with said first and second pistons.

7. A gas refrigerator in accordance with claim 1, wherein said cooling means is disposed in said first compression chamber.

8. A gas refrigerator in accordance with claim 1, wherein said compressing means is driven by reciprocatingly moved means at a predetermined phase difference for compressing a gaseous medium therein.

* * * * *